US007458300B2

(12) United States Patent
Williams

(10) Patent No.: US 7,458,300 B2
(45) Date of Patent: Dec. 2, 2008

(54) PILL SPLITTER

(75) Inventor: Peter C. Williams, Newburyport, MA (US)

(73) Assignee: Best Remedies Holdings, LLC, Newburyport, MA (US)

( * ) Notice: Subject to any disclaimer, the term of this patent is extended or adjusted under 35 U.S.C. 154(b) by 486 days.

(21) Appl. No.: 11/093,734

(22) Filed: Mar. 30, 2005

(65) Prior Publication Data

US 2006/0138190 A1 Jun. 29, 2006

Related U.S. Application Data

(60) Provisional application No. 60/639,844, filed on Dec. 28, 2004.

(51) Int. Cl.

| | |
|---|---|
| ***B26F 3/00*** | (2006.01) |
| ***B26F 3/02*** | (2006.01) |
| ***B65H 35/00*** | (2006.01) |
| ***B65H 35/10*** | (2006.01) |

(52) U.S. Cl. ..... 83/13; 225/1; 225/97; 225/93; 225/103

(58) Field of Classification Search ..... 30/114, 30/113.1, 170.1, 170.2, 780, 794, 303, 305, 30/315; 225/1, 93, 96, 96.5, 103, 89, 104, 225/13, 97

See application file for complete search history.

(56) References Cited

U.S. PATENT DOCUMENTS

| | | | | |
|---|---|---|---|---|
| 1,581,310 | A * | 4/1926 | Fetschan | 30/303 |
| 3,517,871 | A * | 6/1970 | Gaffney et al. | 225/103 |
| 5,118,021 | A * | 6/1992 | Fiocchi | 225/103 |
| 5,322,227 | A * | 6/1994 | Fiocchi | 241/100 |
| 5,431,078 | A * | 7/1995 | Ricard et al. | 83/870 |
| 5,634,272 | A | 6/1997 | Samuelson | |
| 5,944,243 | A * | 8/1999 | Weinstein | 225/93 |
| 6,216,577 | B1 * | 4/2001 | Lira-Nunez et al. | 83/745 |
| 6,474,525 | B1 | 11/2002 | Reitano | |
| D468,023 | S * | 12/2002 | Buckley et al. | D24/220 |
| 6,644,528 | B1 * | 11/2003 | Reitano | 225/1 |
| 6,739,488 | B1 * | 5/2004 | Sharpe | 225/93 |
| 6,968,987 | B1 * | 11/2005 | Reitano | 225/1 |
| 2003/0019900 | A1 | 1/2003 | Dienst | |
| 2003/0084574 | A1 | 5/2003 | Eric | |

FOREIGN PATENT DOCUMENTS

| | | |
|---|---|---|
| WO | WO 03/068662 | 8/2003 |

OTHER PUBLICATIONS

AccuCut Rx™ Personal Tablet Cutter [online], 2003 [retrieved on Jan. 30, 2006]. Retrieved from the Internet <URL: http://www.linksmed.com/accu[13] overview.html.

* cited by examiner

*Primary Examiner*—Ghassem Alie
*Assistant Examiner*—Bharat C Patel
(74) *Attorney, Agent, or Firm*—Hamilton, Brook, Smith & Reynolds, PC

(57) ABSTRACT

A tablet splitter includes a tablet bed having a bed body with a tablet holding structure for holding a tablet. A base is included having a base side wall with an outer perimeter. The side wall surrounds a recess extending along a longitudinal axis. The recess is shaped for receiving and retaining the bed body of the tablet bed. A cap having a cap side wall engages and slides over the outer perimeter of the base side wall along the longitudinal axis. The cap has an interior with a first splitting member positioned therein for engaging and splitting tablets held by the tablet bed.

13 Claims, 10 Drawing Sheets

PILL SPLITTER

RELATED APPLICATION

This application claims the benefit of U.S. Provisional Application No. 60/639,844, filed Dec. 28, 2004. The entire teachings of the above application are incorporated herein by reference.

BACKGROUND

Various types of pill or tablet splitters are commonly used by patients to split medication pills or tablets in half when only half a dose is required. The pills can be of varying shapes and sizes so that cutting a pill into identical halves sometimes can be difficult.

SUMMARY

The present invention provides a tablet splitter including a tablet bed having a bed body with a tablet holding structure for holding a tablet. A base is included having a base side wall with an outer perimeter. The side wall surrounds a recess extending along a longitudinal axis. The recess is shaped for receiving and retaining the bed body of the tablet bed. A cap having a cap side wall engages and slides over the outer perimeter of the base side wall along the longitudinal axis. The cap has an interior with a first splitting member positioned therein for engaging and splitting tablets held by the tablet bed.

In particular embodiments, the tablet bed can have at least one extension tab extending laterally from the bed body, wherein the side wall of the base has a rim with at least one base notch for receiving the at least one extension tab extending from the bed body. The at least one extension tab can extend through the side wall of the base and past the outer perimeter. The side wall of the cap can have a rim with at least one cap notch for alignment with the at least one extension tab of the tablet bed that extends past the outer perimeter of the base side wall for allowing the cap to slide over the outer perimeter of the base side wall. The tablet bed can have two extension tabs extending laterally from the bed body from opposite sides, and being aligned with two opposed base notches in the base and two opposed cap notches in the cap. The base can include a second splitting member, wherein the tablet bed is capable of holding the tablet against the second splitting member for splitting when the first splitting member engages the tablet in alignment with the second splitting member. At least one of the first and second splitting members includes a metallic blade. In one embodiment, the first splitting member comprises at least one metallic blade and the second splitting member is a raised support. The raised support can be an elongate ridge-like structure formed integrally within the base and can include an elongate pointed edge. The tablet holding structure of the tablet bed can be shaped for holding a specific medication, tablet dose size and shape. The extension tabs of the tablet bed can include identifying information specifying the medication type and dose size. The tablet bed can be removably mounted in the base. A plurality of tablet beds can be included, each tablet bed having a tablet holding structure and identifying information corresponding to a specific medication type and dose size. In other embodiments, the first splitting member can include multiple blades.

The present invention can provide a pill or tablet splitter which is capable of cutting a variety of different sized and shaped pills or tablets into substantially equal portions, or other suitably desired portions. The pill splitter in particular embodiments can include a base having a fulcrum rail, a tablet bed shaped for holding a desired tablet, and a top piece having a razor for cutting the tablet against the fulcrum rail.

BRIEF DESCRIPTION OF THE DRAWINGS

The foregoing and other objects, features and advantages of the invention will be apparent from the following more particular description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Figure 1:
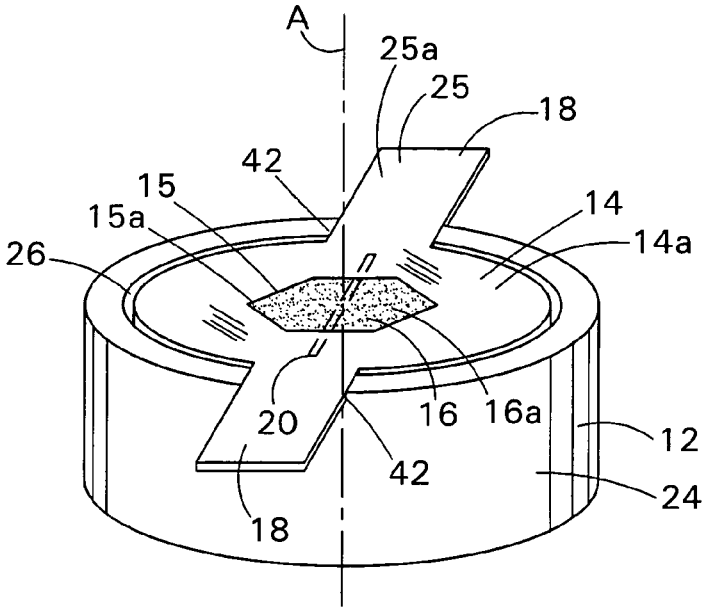
FIG. 1 is a perspective view of an embodiment of a base of a pill or tablet splitter in accordance with the present invention with a tablet bed positioned on the base.
Figure 2A:
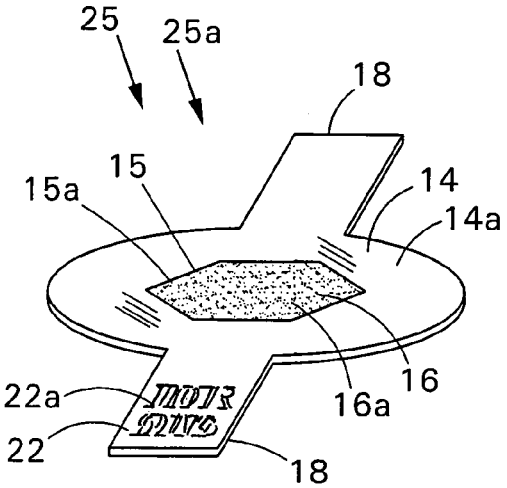
FIGS. 2A-2C depict schematic perspective views of examples of different possible tablet beds.
Figure 2C:
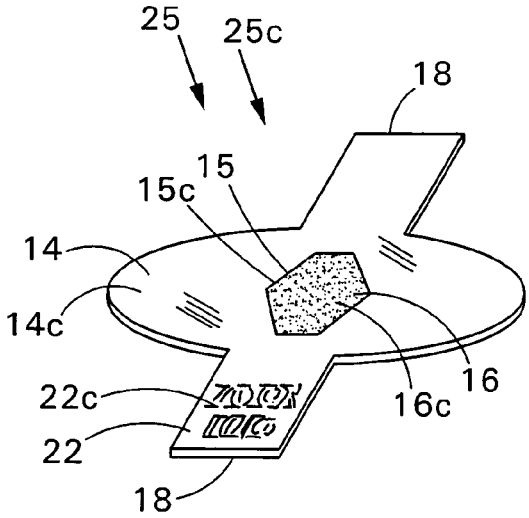
Figure 2B:
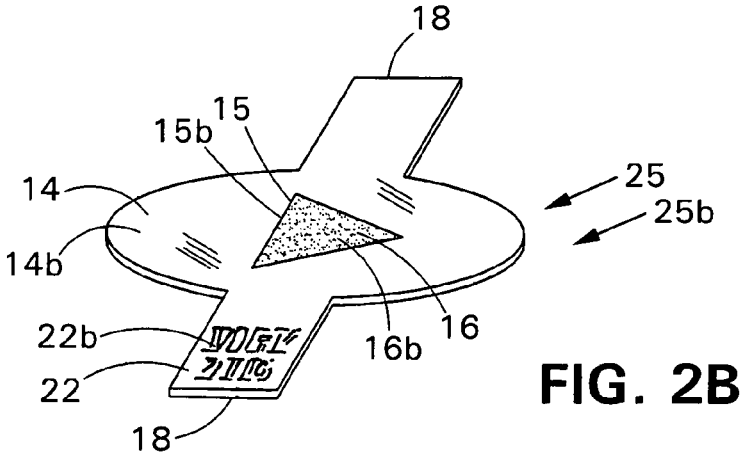
Figure 3A:
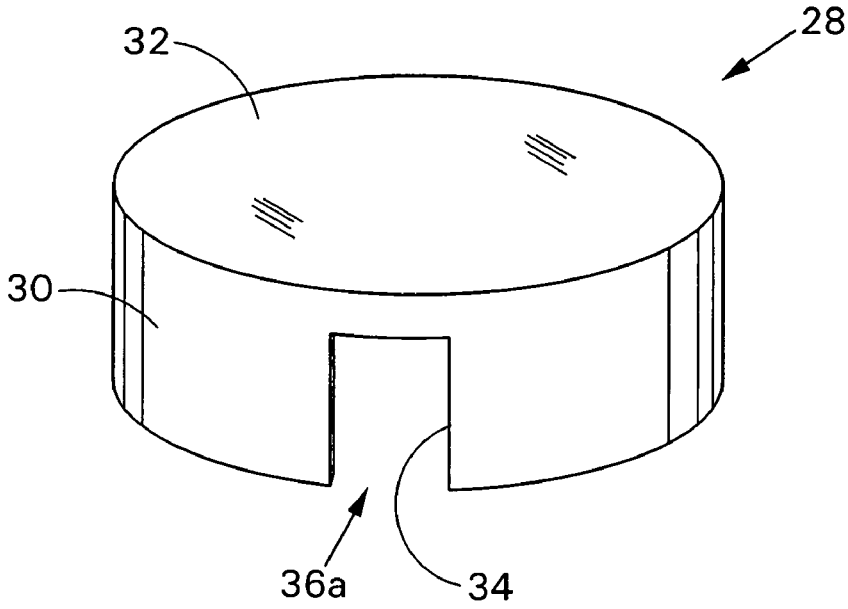
FIG. 3A is a perspective view of an embodiment of a cap viewed from the top.
Figure 3B:
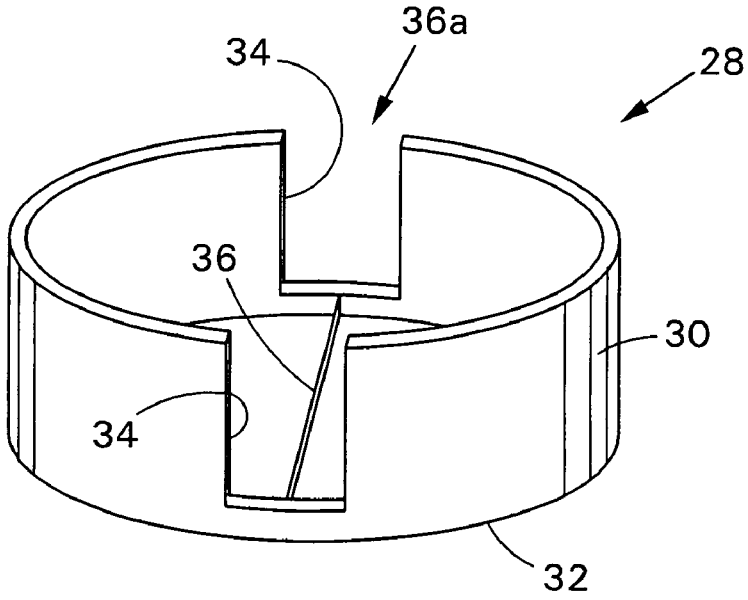
FIG. 3B is a perspective view of the cap of FIG. 3A viewed from the bottom.
Figure 4:
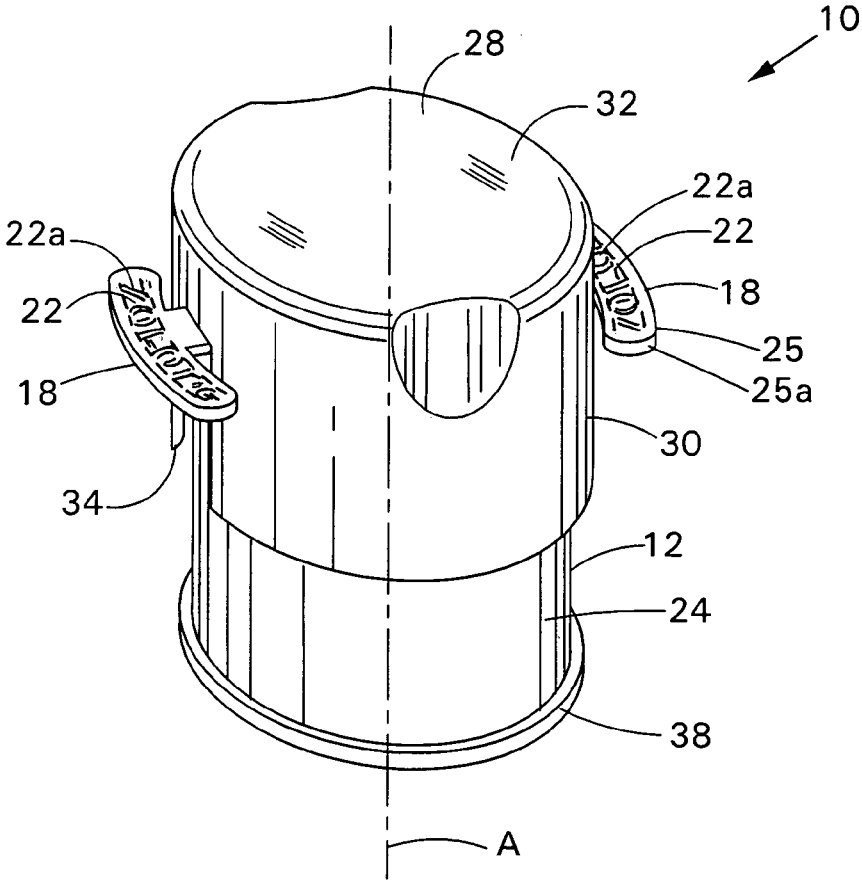
FIG. 4 is a perspective view of an embodiment of the present invention pill or tablet splitter when assembled.
Figure 5:
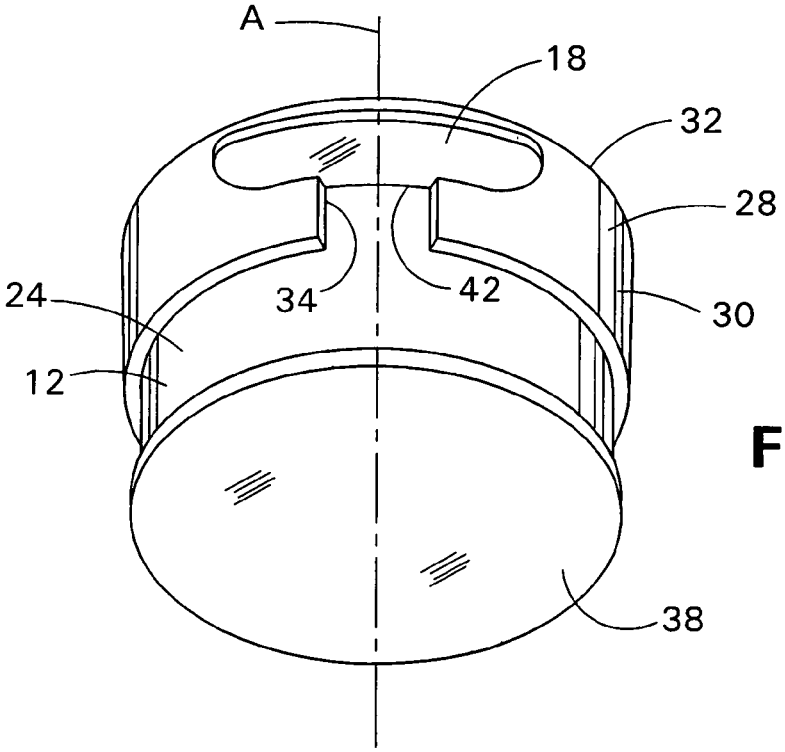
FIG. 5 is a bottom perspective view of the embodiment of FIG. 4.
Figure 6A:
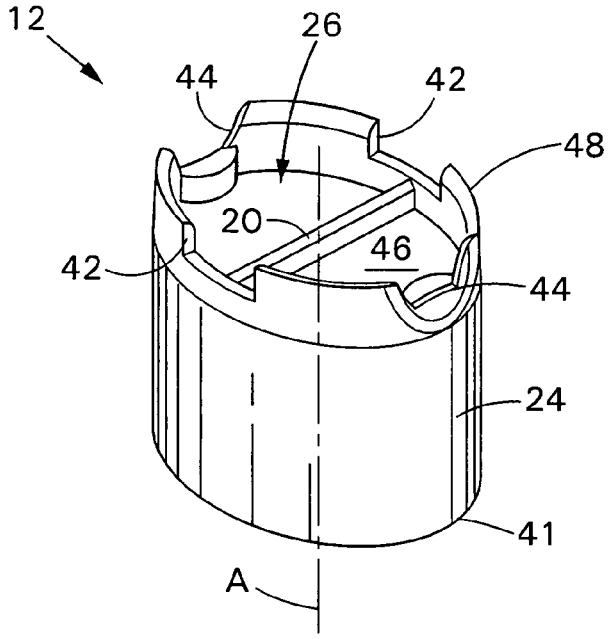
FIG. 6A is a top perspective view of a base or bottom for the embodiment of FIG. 4.
Figure 6B:
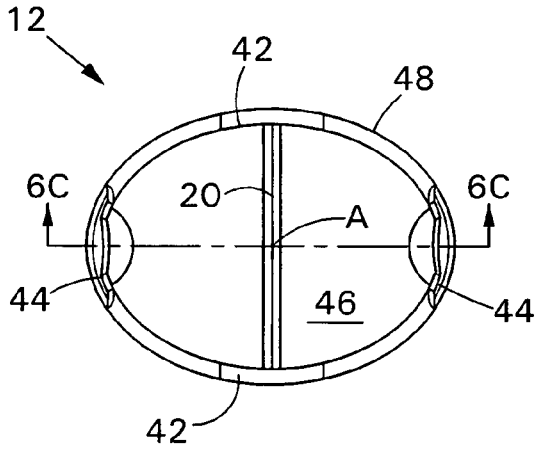
FIG. 6B is a top view of the base or bottom of FIG. 6A.
Figure 6C:
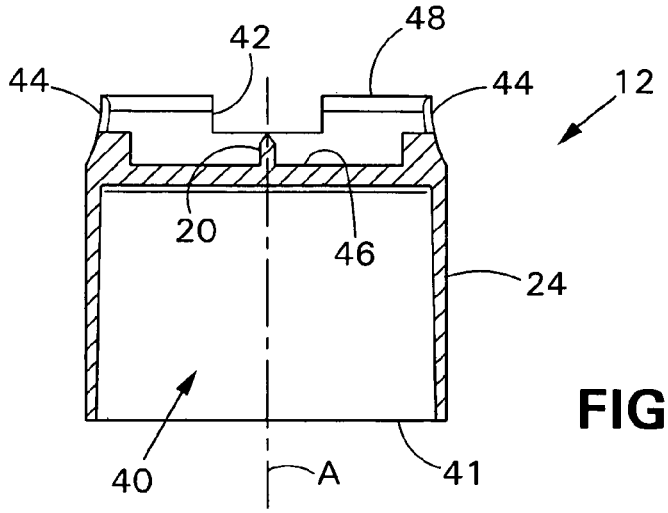
FIG. 6C is a side sectional view of the base or bottom of FIG. 6A taken along lines 6C-6C.
Figure 7:
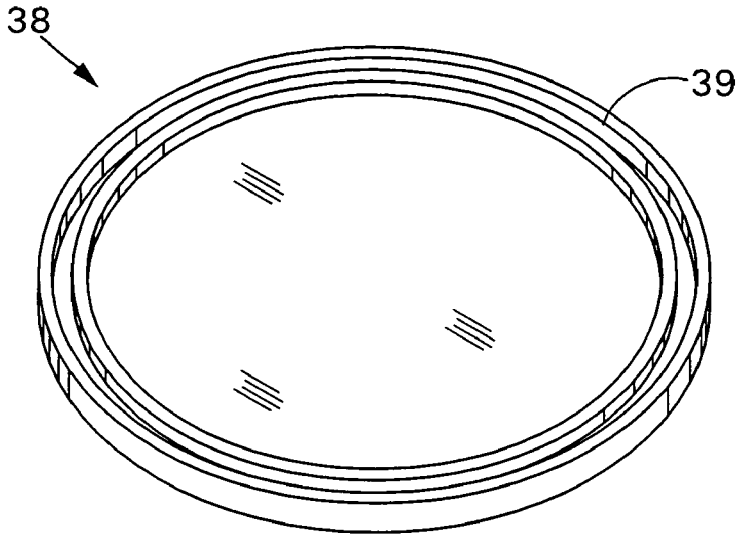
FIG. 7 is a perspective view of a bottom cover for the embodiment of FIG. 4.
Figure 8A:
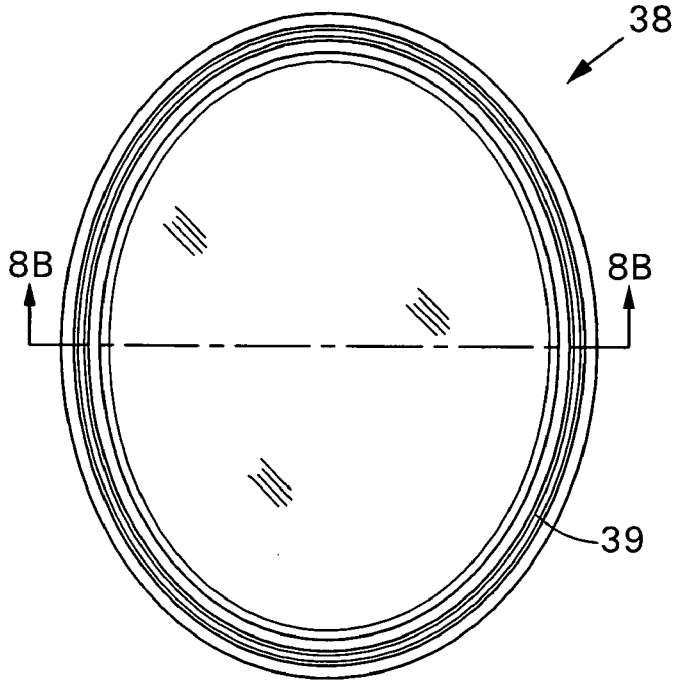
FIG. 8A is a top view of the bottom cover of FIG. 7.
Figure 8B:
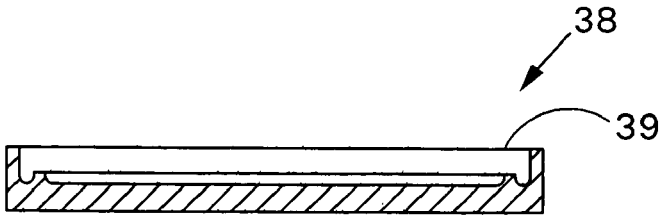
FIG. 8B is a side sectional view of the bottom cover of FIG. 7 taken along lines 8B-8B.

The present invention is directed to a pill or tablet splitter 10, which in particular embodiments can generally include a base 12, a tablet bed 25 and a top piece or cap 28 such as shown in FIGS. 1-3B. The base 12 can have a side wall 24 surrounding a recess 26 extending along a longitudinal axis A. The recess 26 can be shaped for receiving and retaining the bed body 14 of the tablet bed 25. The tablet bed 25 can have opposed extension tabs 18 extending laterally from the bed body 14 which engage and pass through corresponding openings, gaps, notches or slots 42 in the side wall 24. The extension tabs 18 can stabilize the position of the tablet bed 25 within the base 12 and can facilitate insertion and removal. The bed body 14 can include a tablet holding structure 15 for holding a tablet 16 against a splitting member such as a raised support ridge or fulcrum rail 20 that is positioned within the recess 26. The tablet bed 25 can be a specific tablet bed 25*a*-25*c* (FIGS. 2A-2B) having bed body 14*a*-14*c* with a tablet holding structure 15*a*-15*c* of a specific configuration for holding a specific type of medication, dose size and shape of a tablet 16*a*-16*c* in a predetermined orientation or position against the splitting member 20 for splitting. The extension tabs 18 can include medication identifying information 22*a*-22*c*. The cap 28 has a cap side wall 30 and top 32, and can engage and slide over the outer perimeter of the side wall 24 of the base 12 along the longitudinal axis A. The cap 28 has an interior 36*a* with a splitting arrangement or member such as a metallic or steel cutting blade 36, for example, a razor blade, mounted against the top 32. The cutting blade 36 engages and splits tablets 16 held by the tablet bed 25 against the fulcrum rail 20 while in alignment with the fulcrum rail 20.

Referring to the embodiment depicted in FIGS. 4-6C, the base 12 can be oval and can be approximately 1¾" long by 1⅜" wide by 1⅛" high, and can be made of plastic, such as opaque, off-white ABS. There can be a short rim or lip 48 on the top of the base 12 approximately ⅛" high and indented approximately 1/16" from the edge of the base 12. The lip 48 can run around the top of the base 12, but with two symmetrical openings, slots, notches or gaps 42 centered (and opposite each other) on each long side of the oval, and arched openings or notches 44 on the ends. The gaps 42 can be approximately ½" wide. One function of the lip 48 is to hold tablet beds 25 in place. A thin ABS fulcrum rail 20 can be molded within the base 12 across the top wall 46 of the base 12. The fulcrum rail 20 can be approximately ⅛" wide at its bottom (where it is affixed to the base 12) and can come to a sharpish edge at its minimum width (for example, about 1/32" to about 1/64") for maximizing splitting pressure.

A function of the fulcrum rail 20 is to hold the tablet 16 in suspension, thus allowing the tablet 16 to split when ruptured by the cutting blade 36 that guillotines it from the top. The fulcrum rail 20 can act as an edged cutting block that interacts with the cutting blade 36 to cleave the tablets 16. The top of the fulcrum rail 20 can be level with the top of the base 12 (at the same level as the bottom of the lip 48). The fulcrum rail 20 can sit in a depression or interior 26 that is below the top level of the base 12 where the lip 48 begins. That depression or interior 26 can also be oval and can be about 90% of the size of the base 12 as a whole. The depression or interior 26 in one embodiment can be about 3/16" deep. The fulcrum rail 20 can run across the narrow dimension of the oval, run parallel and in alignment with, and register stem to stern, below the cutting blade 36.

The base 12 can have a bottom compartment 40 for storing pills or tablets 16. A bottom cover 38 (FIGS. 4, 7, 8A and 8B) can be employed for enclosing the bottom compartment. The bottom cover 38 can have a rim structure 39 which can snap onto the rim 41 of the bottom compartment 40 and can be formed of plastic.

Figure 9A:
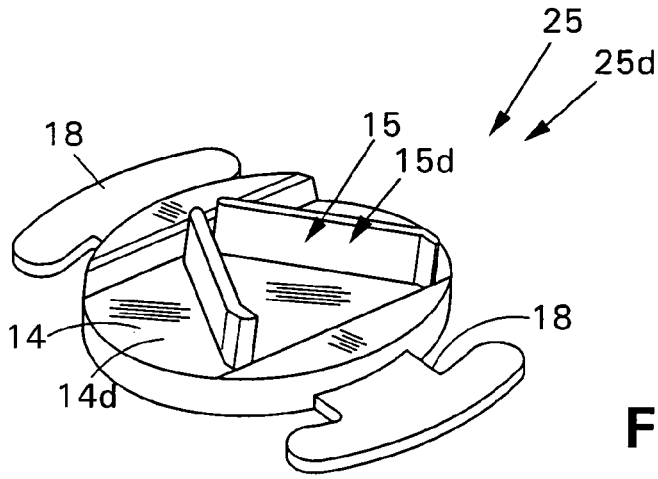
FIG. 9A is a perspective view of an embodiment of a generic tablet bed.
Figure 9B:
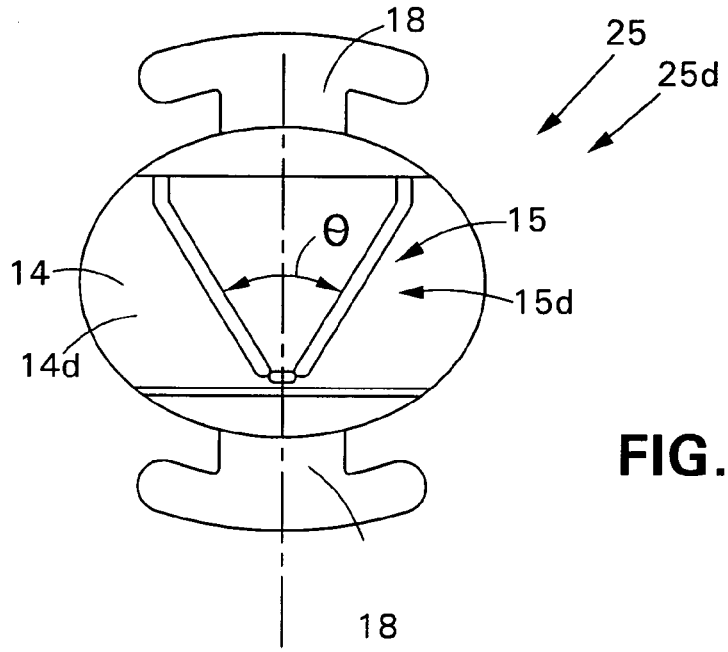
FIG. 9B is a top view of the tablet bed of FIG. 9A.
Figure 9C:
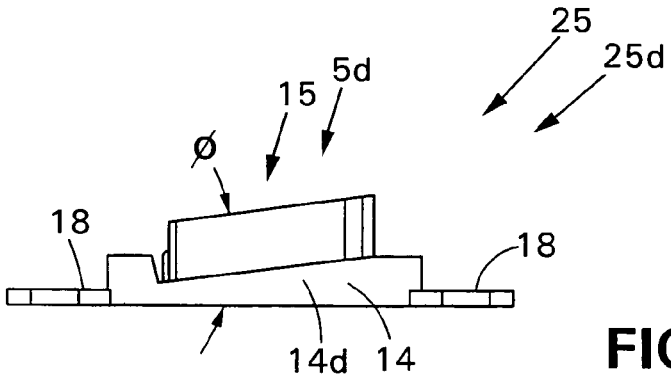
FIG. 9C is a side view of the tablet bed of FIG. 9A.
Figure 10A:
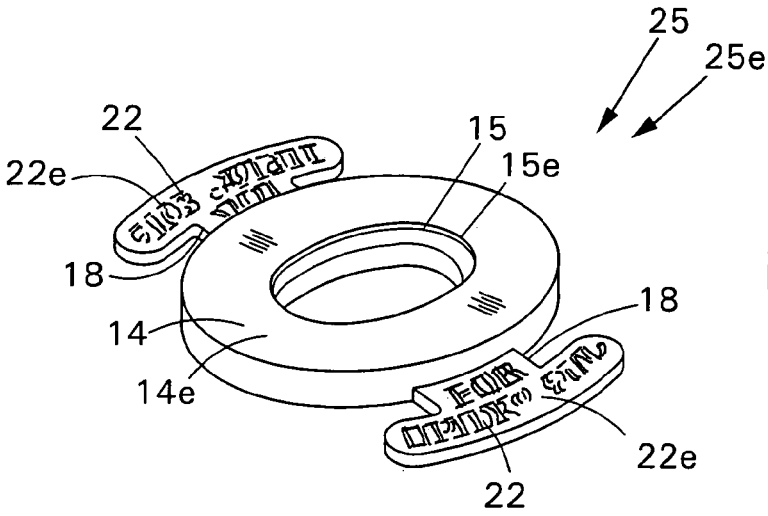
FIG. 10A is a perspective view of an embodiment of a tablet bed designed and shaped for the splitting of a LIPITOR® tablet.
Figure 10B:
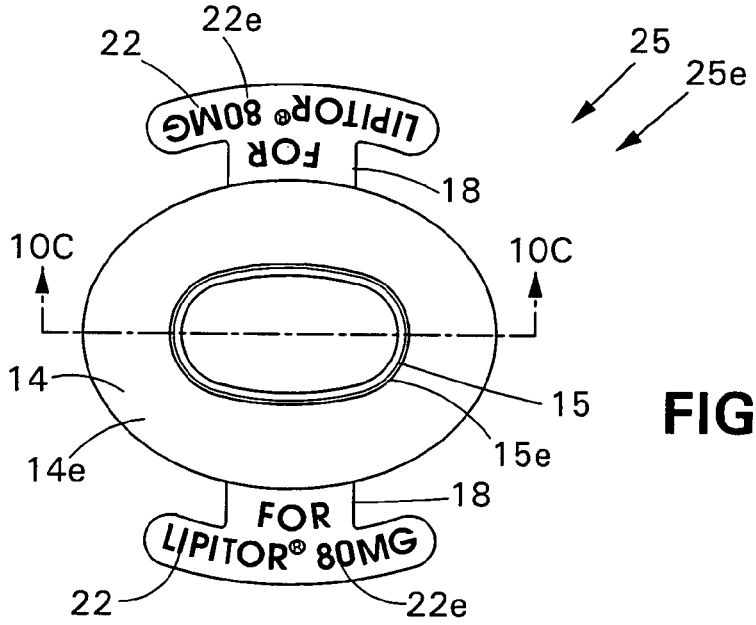
FIG. 10B is a top view of the tablet bed of FIG. 10A.
Figure 10C:
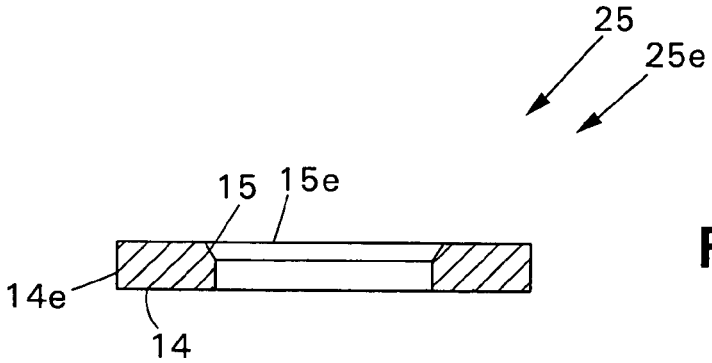
FIG. 10C is a side sectional view of the tablet bed of FIG. 10A taken along lines 10C-10C.
Figure 11A:
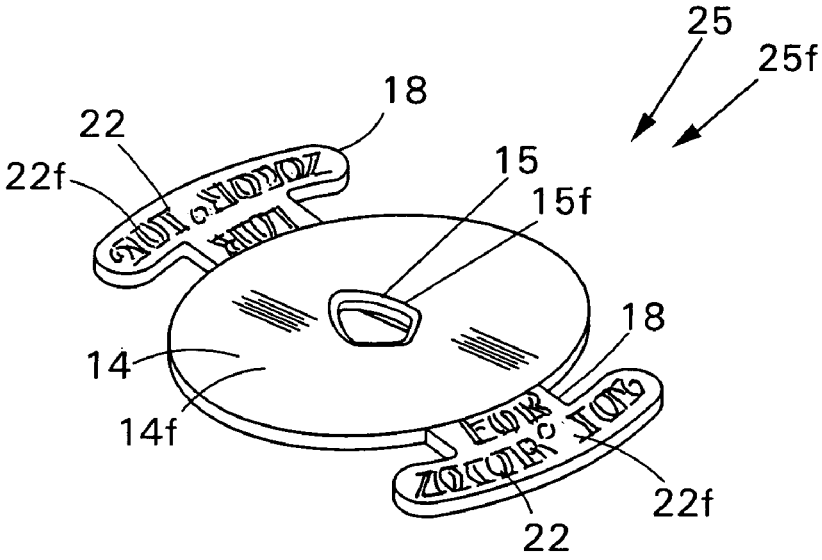
FIG. 11A is a perspective view of an embodiment of a tablet bed designed and shaped for the splitting of a ZOCOR® tablet.
Figure 11B:
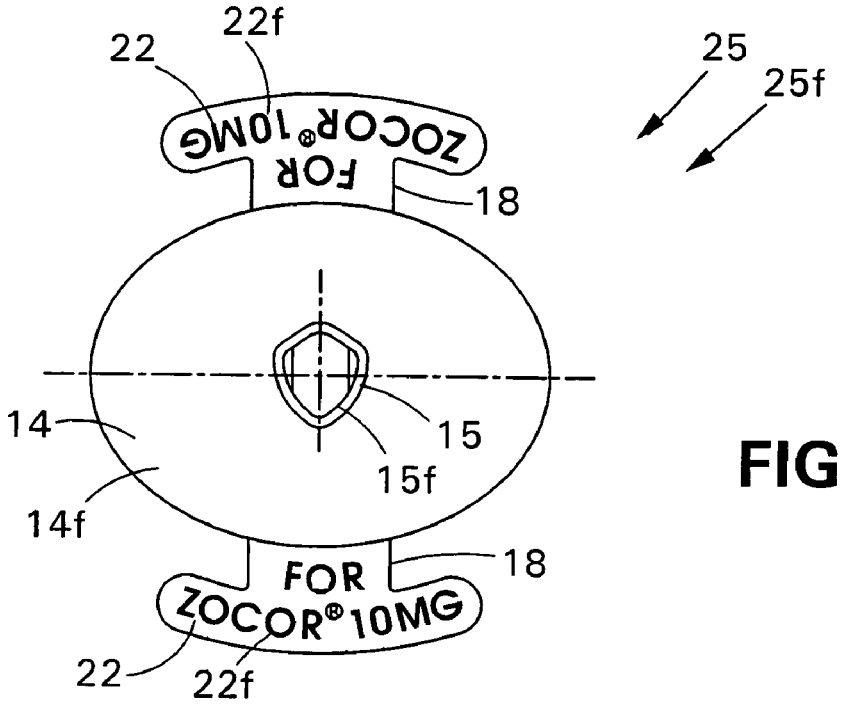
FIG. 11B is a top view of the tablet bed of FIG. 11A.
Figure 12A:
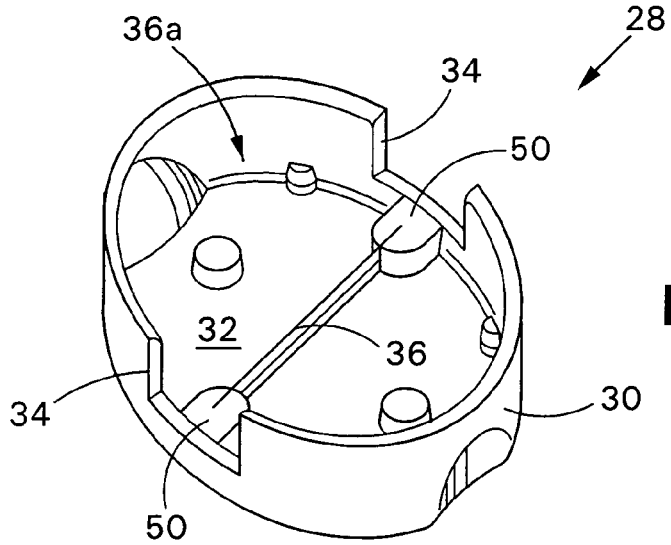
FIGS. 12A and 12B are a perspective views of a top piece or cap for the embodiment of FIG. 4.
Figure 12B:
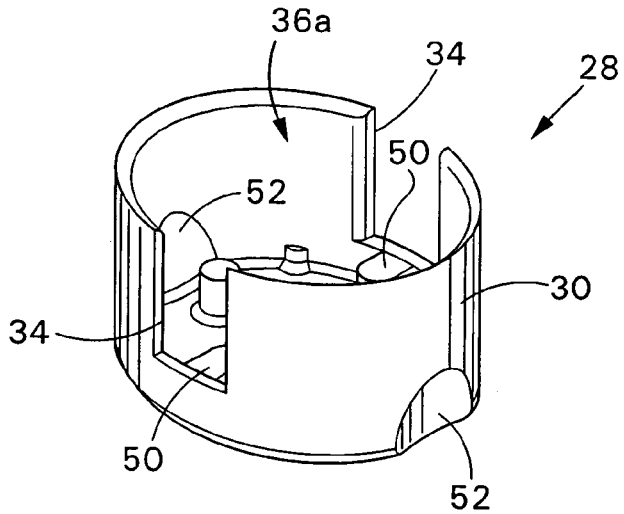
Figure 12C:
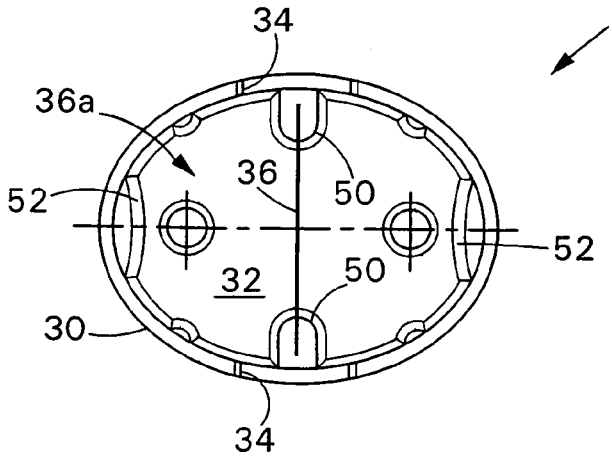
FIG. 12C is a top view of the cap of FIGS. 12A and 12B.
Figure 12D:
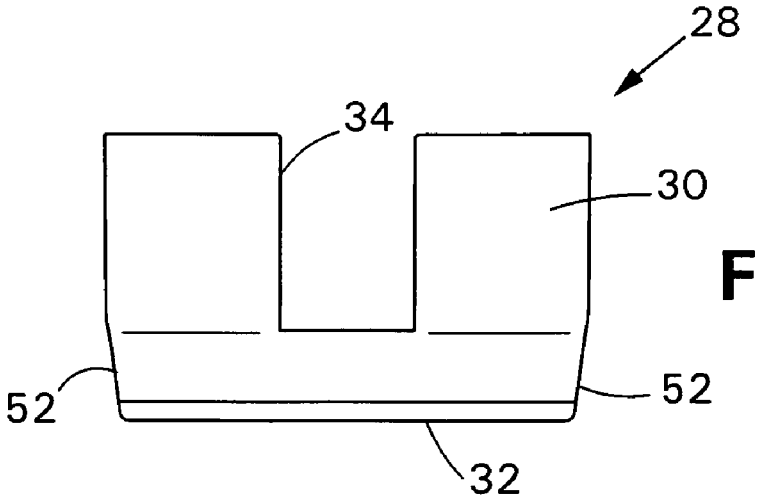
FIG. 12D is a side view of the cap of FIGS. 12A and 12B.

FIGS. 9A-9C depict an embodiment of a generic tablet bed 25*d* having a bed body 14*d* with a tablet holding structure 15*d* that has sides at an angle θ for holding a variety of tablets 16. The sides can have a top angle ϕ. FIGS. 10A-10C depict an embodiment of a tablet bed 25*e* having bed body 14*e* with a tablet holding structure 15*e* such as a cavity shaped for holding a LIPITOR® tablet for splitting of the tablet. The extension tabs 18 include enlarged ends with identifying information 22*e* identifying the medication and the dose size. FIGS. 11A and 11B depict an embodiment of a tablet bed 25*f* having a bed body 14*f* with a tablet holding structure 15*f* such as a cavity shaped for holding a ZOCOR® tablet for splitting of the tablet. The extension tabs 18 include enlarged ends with identifying information 22*f* for the medication and dose size. The cavities in the bed bodies 14*e* and 14*f* can have angled or radiused upper edges for facilitating the insertion of a tablet 16 therein.

The tablet beds 25*a*-25*c*, 25*e* and 25*f* can be formed of plastic, can be oval and can have a centered cutout or cavity forming the tablet holding structure 15*a*-15*c*, 15*e* and 15*f* corresponding to the shape and size of the medication tablet 16 that each different bed 25 accommodates. A function of the tablet bed 25 is to hold each specific type or shape of medication tablet 16 in exact register over the fulcrum rail 20 and under the cutting blade 36 (that is part of the top piece) so that each tablet 16 splits accurately. The tablet beds 25 can fit inside the lip 48 and on top of the base 12. The edges of the tablet beds 25 can rest on the top of the fulcrum rail 20 edge and on the ridge between the base edge and the beginning of the depression or interior 26 within which the fulcrum rail 20 sits. The tablet beds 25 can vary in thickness dependent on the specific medication tablet 16 each holds. The internal shape (cutout) of the tablet holding structure 15 of the tablet beds 25 can also vary according to the medication tablet 16 each holds. The external perimeters of the tablet beds 25 can all be identical and fit snugly into the lip 48 on the top of the base 12. Each tablet bed 25 can have two extension tabs 18 on the long side of the oval. These extension tabs 18 can be just about as wide as the notches 42 in the lip 48 (to fit snugly, but not tightly). A function of these extension tabs 18 can be to: a) provide holding spots when an individual uses the tablet splitter 10, and b) provide a place where identifying information 22*a*-22*c*, 22*e* and 22*f* can be printed identifying the type and dose of medication each different tablet 16 that tablet bed 25*a*-25*c*, 25*e* and 25*f* holds. Each tablet bed 25 within a "medication family" can be the same color, regardless of dose strength. The tablet beds 25 across medication families can be different colors.

Referring to FIGS. 12A-12D, the cap 28 can be formed of plastic and, like the base 12 and tablet beds 25, can be oval and can be of a dimension that fits snugly, but not tightly, over the base 12. The close fit in conjunction with the outer shape can maximize registration/orientation of the cap 28 to the base 12. The cap 28 can serve as a top piece or cover for the base 12. The cap 28 in one embodiment can have sides approximately ⅞" high with a flat top 32. The cap 28 can have openings, slots, notches, cutouts/gaps 34 in its sides that correspond to the extension tabs 18 and notches 42 on the tablet beds 25 and base 12, respectively. A razorblade for the cutting blade 36 can be inserted inside the top 32 between supports 50. The cutting blade 36 can run across the narrow dimension of the oval, run parallel to and register in alignment above the fulcrum rail 20. Opposite ends of the cap 28 can have indents 52 for a person's fingers to facilitate gripping the cap 28. When the cap 28 is put on the base 12, it can slide down the height of the base 12 until the cutting blade 36 comes to a rest on the top of the tablet bed 25 or inserted tablet 16. The gaps 34 in the cap 28 can slide past the extension tabs 18 on the tablet bed 25. The person operating the tablet splitter 10 can place the cap 28 in position, push it down, whack it to effect the split, then place his finger on the two extension tabs 18 to pull up on the cap 28 for retrieval.

Figure 13A:
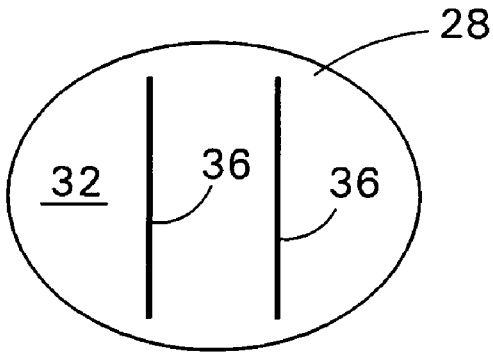
FIG. 13A is a plan schematic view of a parallel cutting blade configuration in an embodiment of the cap.
Figure 13B:
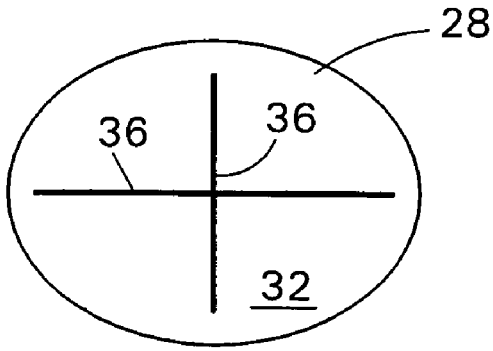
FIG. 13B is a plan schematic view of a crossed or angled cutting blade configuration in an embodiment of the cap.

Furthermore, the cutting blade 36 can have varied positions and the tablets can be cut in other desirable proportions, for example, thirds or quarters. The splitting arrangement or member can include multiple blades 36, for example, parallel, crossed or angled relative to each other (FIGS. 13A and 13B), with the splitting member 20 of base 12 being appropriately configured. Two parallel blades 36 such as in FIG. 13A can cut a tablet into thirds, while blades 36 in a cross cut arrangement (FIG. 13B) can cut a tablet into quarters. Furthermore, other blade arrangements can be employed for cutting tablets in other proportions.

While this invention has been particularly shown and described with references to preferred embodiments thereof, it will be understood by those skilled in the art that various changes in form and details may be made therein without departing from the scope of the invention encompassed by the appended claims.

For example, although particular shapes, materials, and dimensions have been described, it is understood that the materials, shapes, and dimensions can vary depending upon the application at hand. Other shapes can be possible such as round, triangular, square, polygonal, curved, angled, combinations thereof, etc. Other types of plastics can be used. In addition, other suitable materials can be used such as glass, metal, ceramics, etc. Combinations of different suitable materials can also be used. In some embodiments, the cutting blade 36 can be molded in the cap 28. In such embodiments, the cutting blade 36 would be the same material as the cap 28, and can be glass, metal, ceramic, plastic, etc. The tablet splitter can have the cutting blade 36 in the base 12 instead of in the cap 28, or can have cutting blades 36 in both locations.

What is claimed is:

1. A tablet splitter comprising:

a tablet bed having a bed body with a tablet holding structure for holding a tablet, the tablet bed having at least one extension tab extending laterally from the bed body;

a base having a base side wall with an outer perimeter, the side wall surrounding a recess extending along a longitudinal axis, the recess being shaped for receiving and retaining the bed body of the tablet bed, the side wall of the base having a rim with at least one base notch for receiving the at least one extension tab extending from the bed body, the at least one extension tab extending through the side wall of the base and past the outer perimeter; and a cap having a cap side wall for engaging and sliding over the outer perimeter of the base side wall along the longitudinal axis, the cap having an interior with a first splitting member positioned therein for engaging and splitting the tablet held by the tablet bed, and wherein the side wall of the cap has a rim with at least one cap notch for alignment with the at least one extension tab of the tablet bed that extends past the outer perimeter of the base side wall for allowing the cap to slide over the outer perimeter of the base side wall.

2. The tablet splitter of claim 1 in which the tablet bed has two extension tabs extending laterally from the bed body from opposite sides, and being aligned with two opposed base notches in the base and two opposed cap notches in the cap.

3. The tablet splitter of claim 1 in which the base includes a second splitting member, wherein the tablet bed is capable of holding the tablet against the second splitting member for splitting when the first splitting member engages the tablet in alignment with the second splitting member.

4. The tablet splitter of claim 3 in which at least one of the first and second splitting members includes a metallic blade.

5. The tablet splitter of claim 4 in which the first splitting member comprises at least one metallic blade.

6. The tablet splitter of claim 5 in which the first splitting member comprises multiple blades.

7. The tablet splitter of claim 5 in which the second splitting member comprises a raised support.

8. The tablet splitter of claim 7 in which the raised support comprises an elongate ridge-like structure formed integrally within the base.

9. The tablet splitter of claim 8 in which the ridge-like structure includes an elongate pointed edge.

10. The tablet splitter of claim 3 in which the tablet holding structure of the tablet bed is shaped for holding a specific medication, tablet dose size, arid shape.

11. The tablet splitter of claim 10 in which extension tabs on the tablet bed include identifying information specifying the medication type and dose size.

12. The tablet splitter of claim 10 in which the tablet bed is removably mountable in the base.

13. The tablet splitter of claim 10 further comprising a plurality of tablet beds, each tablet bed having a tablet holding structure and identifying information corresponding to a specific medication type and dose size.

* * * * *